US007219387B1

(12) United States Patent
Moore

(10) Patent No.: US 7,219,387 B1
(45) Date of Patent: May 22, 2007

(54) FOOT CLEANSING DEVICE

(76) Inventor: Toby Curtis Moore, 5425 Snyder La. # 68, Rohnert Park, CA (US) 94928

( * ) Notice: Subject to any disclaimer, the term of this patent is extended or adjusted under 35 U.S.C. 154(b) by 280 days.

(21) Appl. No.: 10/781,413

(22) Filed: Feb. 17, 2004

(51) Int. Cl.
*A47K 7/02* (2006.01)
*A47K 7/03* (2006.01)

(52) U.S. Cl. ..... 15/160; 15/161; 15/244.3; 15/104.92; 15/210.1; 4/606; 601/136; 601/138

(58) Field of Classification Search ..... 15/160, 15/161, 244.3, 104.92, 210.1; 4/606; 601/136, 601/138, 27, 28
See application file for complete search history.

(56) References Cited

U.S. PATENT DOCUMENTS 2,503,174 A * 4/1950 Salvadore ..... 4/661
3,283,756 A * 11/1966 Turley ..... 601/166
3,939,825 A * 2/1976 Krummenacher ..... 601/104
4,520,525 A * 6/1985 Yogi et al. ..... 15/104.92
5,996,163 A * 12/1999 Galizia ..... 15/160
6,684,444 B2 * 2/2004 Wheeler et al. ..... 15/110
6,735,807 B2 * 5/2004 Brent ..... 15/104.92
2003/0204927 A1 * 11/2003 Kelly ..... 15/160

* cited by examiner

*Primary Examiner*—Gary K. Graham

(57) ABSTRACT

An apparatus for the cleansing, abrading, or massaging of a foot includes a container that is placed on the floor under a shower. Openings are provided in the bottom of the container for water to drain. A first screen is disposed over the bottom of the container as a filter. A section of foam is surrounded by a second screen and is placed on the bottom of the container. A lining of artificial grass is disposed over the foam and it extends up and over the sides of the container where it is secured to the container. Any of a variety of abrasive materials is placed on the lining. In use, the person stands in the container and takes a shower while normal movement of the feet massage, clean, and abrade each foot including the sides and between the toes. Water flows through the lining and out through the bottom of the container while maintaining the abrasive materials in the container.

12 Claims, 1 Drawing Sheet

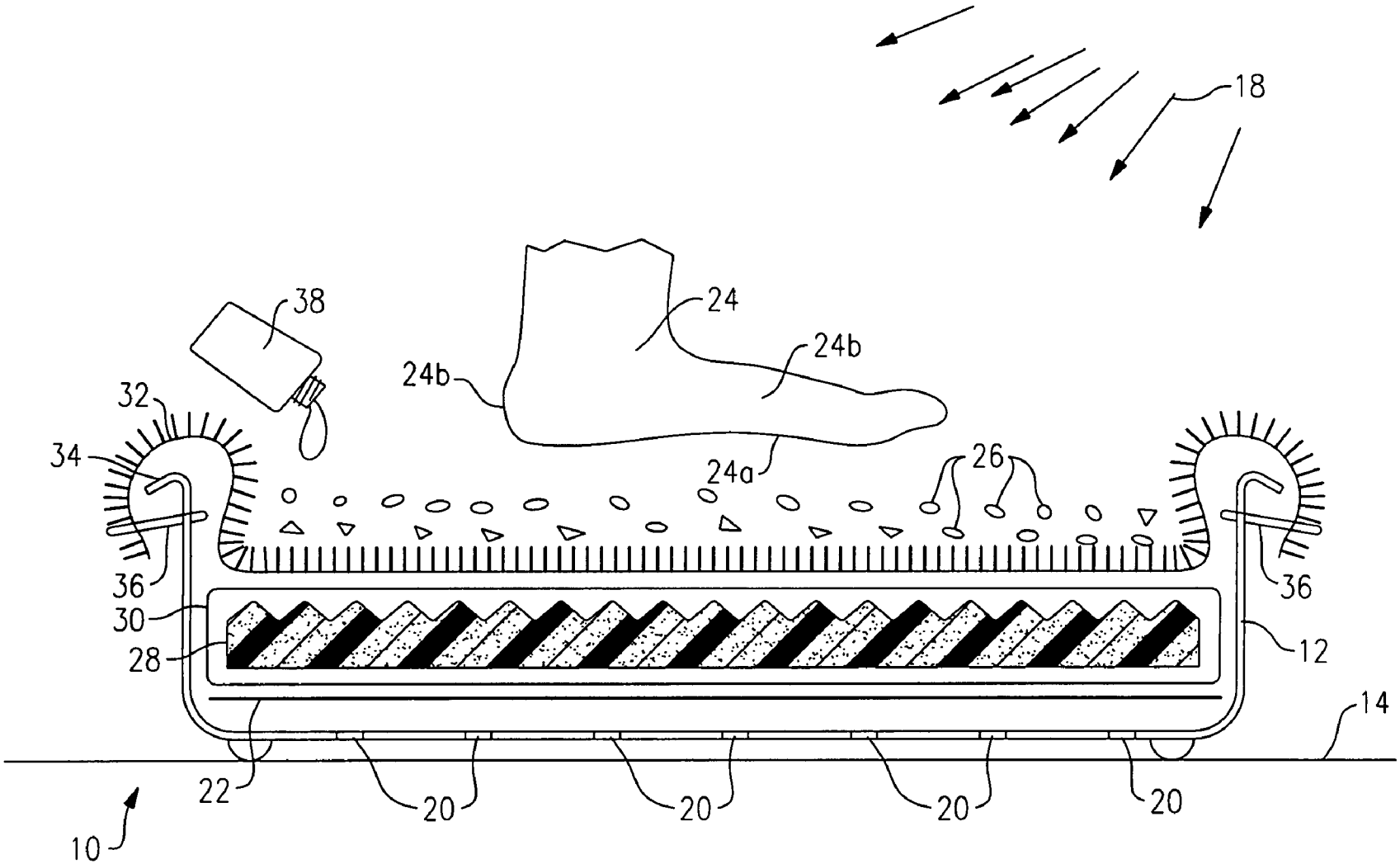
18
38
24
24b
24b
24a
26
32
34
36
36
30
28
22
20
20
20
20
20
12
14
10

FOOT CLEANSING DEVICE

BACKGROUND OF THE INVENTION

1. Field of the Invention

The present invention, in general relates to pediatrics and, more particularly, to a device for use in a shower that is adapted for cleaning and abrading the skin on a foot.

The foot is a neglected portion for most people. It is generally difficult to clean when a person is in the shower. The person has to stand on one leg, which is dangerous, while cleaning the opposite foot or the person is required to bend down while standing under the shower. Many people lack flexibility to bend down and reach their feet. Consequently, people often omit washing their feet or if they do, they perform only a cursory cleansing.

These problems are especially difficult for people who suffer from disorders such as obesity, back problems, or other handicaps.

The foot is also prone to many dermatologic problems as well. People develop athlete's foot (one of many possible fungal infections), corns, calluses, and the like. Many people neglect treating these disorders for similar reasons as mentioned above.

People who suffer from athlete's foot know how severely their feet can itch. Minor abrasion of the affected area can alleviate itching while helping to remove layers of dead skin and promote the efficacy of certain athlete's foot medications that are topically applied. People with calluses on their feet know how difficult it is to bend down and use a hand held tool to abrade away their calluses.

Psoriasis and eczema sufferers also similarly benefit from abrading some of the dead skin off of the affected areas before applying any medication to the area.

It is also desirable to be able to massage a foot. This is well known to relax and calm a person.

Accordingly, there exists today a need for an apparatus and method for cleaning the feet of a user during the normal course of taking a shower that helps ameliorate the aforementioned difficulties while abrading dead skin and massaging the foot.

Clearly, such an apparatus and method would be useful and desirable.

2. Description of Prior Art

Devices for cleaning and massaging a foot are, in general, known. For example, the following patents describe various types of these devices:

U.S. Pat. No. 5,520,618 to Massiet, May 28, 1996; and

U.S. Pat. No. 6,142,156 to Brunderman, Nov. 7, 2000.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a foot cleansing device and method that is safe to use.

It is also an important object of the invention to provide a foot cleansing device and method that can be used while in a bathtub or shower stall.

Another object of the invention is to provide a foot cleansing device and method that does not require a user to raise one foot high into the air.

Still another object of the invention is to provide a foot cleansing device and method that can be adapted to massage the feet.

Still yet another object of the invention is to provide a foot cleansing device and method that can be adapted to abrade the feet.

Yet another important object of the invention is to provide a foot cleansing device and method that is adapted to reach raised or arcuate portions of the feet.

Still yet another important object of the invention is to provide a foot cleansing device and method that operates automatically while taking a shower.

Still yet a first additional important object of the invention is to provide a foot cleansing device and method that cleanses the bottom and sides of the feet while taking a shower without requiring any additional time other than that to wash the remainder of the body.

Still yet a second additional important object of the invention is to provide a foot cleansing device and method that cleanses between the toes.

Still yet a third additional important object of the invention is to provide a foot cleansing device and method that can be used with oils, bath crystals, and various soaps.

Briefly, a foot cleansing device and method for cleaning, massaging, and abrading the skin of a foot that is constructed in accordance with the principles of the present invention has a container that is placed on the floor of a bathtub or shower stall where a person taking a shower would normally stand. The container includes feet that elevate a bottom of the container above the floor which allows water to drain out of it. Openings are provided in the bottom of the container for water drainage. A first screen netting is disposed over the bottom of the container to prevent any particulates larger than the openings in the first screen netting from passing through the openings in the bottom of the container. A section of foam that is surrounded by a second screen netting is disposed on the bottom of the container. A lining of artificial grass is disposed over the foam and up and over the sides of the container. The lining is secured to the container. Any of a variety of abrasive materials from fine sand to courser materials is placed on top of the lining along with any bath oil, bath crystals, or soap. In use, the shower is started and the person stands in the container. Normal movement of the feet during a shower clean and abrade dead skin off the feet including the sides of the feet and between the toes, depending to some degree on which type of abrasive material is used. Water from the shower flows through the lining and out through the bottom of the container while maintaining the abrasive materials in the container on top of the lining.

BRIEF DESCRIPTION OF THE DRAWINGS

The FIGURE is a cross-sectional view of a foot cleansing device and method.

DETAILED DESCRIPTION OF THE INVENTION

Referring to the drawing FIGURE is shown, a foot cleansing device and method, identified in general by the reference numeral 10.

A container 12 is placed on the floor 14 of a bathtub or shower stall where a person taking a shower would normally stand. The container 12 includes feet 16 that elevate a bottom of the container above the floor 14 sufficient to allow water coming from a shower 18 to drain through a plurality of openings 20 that are provided in the bottom of the container 12.

A fine first screen netting 22 is disposed on the bottom of the container 12. The first screen netting 22 is formed of any preferred mesh material, including nylon or galvanized screening material, cheese cloth, or any other desired material.

As shown in the FIGURE, the first screen netting 22 is elevated above the bottom. This is only for purpose of improving clarity as to the layers of components that are disposed within the container 12. The first screen netting 22 is preferably adhered directly to the bottom of the container 12 so that it covers all of the openings 20. The remaining components rest directly upon those that are underneath.

The first screen netting 22 prevents larger debris that may wash of a foot 24 of a user from passing through the openings 20 in the bottom of the container 12 and possibly clogging a drain (not shown). It also prevents any of a variety of abrasive materials 26 that may migrate to the bottom of the container 12 from passing through the openings 20 and clogging the drain. The abrasive materials 26 are discussed in greater detail hereinafter.

A section of foam 28 is surrounded by a second screen netting 30. The second netting 30 is similar to the first netting 22, however it fully surrounds the foam 28. It is described in greater detail hereinafter.

The foam 28 and the second netting 30 are disposed on the bottom of the container 12 directly on top of the first screen netting 22. The foam 28 preferably includes a type of foam commonly referred to as "egg crate" foam and is oriented so the points of the foam 28 are disposed upward. The foam 28 provides compression that adapts the foot cleansing device and method 10 to match the shape and contour of the foot 24.

A lining 32 of artificial grass turf (as is commonly used as a carpeting material for exterior porches, decks, or stairs) is disposed over the foam 28 and up and over the sides and a surrounding lip 34 of the container 12. The lining 32 is secured the container by a series of cords 36 that pass through both the lining 32 and the sides of the container 12. Of course many other methods for attaching the lining 32 are anticipated, for example, VELCRO, or other types of fasteners may be used.

The abrasive materials 26 are placed on top of the lining 32. Any preferred material may be used for the abrasive materials 26 from fine sand to courser grades of sand to large and highly abrasive materials, for example, gravel's, including epoxy coated aquarium gravel.

The abrasive materials 26 may be changed as the foot 24 adapts as well. For example, a user may at first have a tender underside 24*a* of his foot 24. He or she may begin by using a fine grade of "play box" sand for a period of time. Then, as the foot 24 acclimates, a courser grade of sand may be used and the process repeated as often as desired. In this manner, the underside 24*a* of the foot 24 is trained to tolerate standing on coarser materials.

The abrasive materials 26 are also varied to suit the intended purpose of the foot cleansing device and method 10. For example, to simply automatically cleanse the foot 24, the finer grades of sand are typically used for the abrasive materials 26. Prior to taking the shower 18, a soap 38 is optionally poured into the container 12 on top of the abrasive materials 26.

The user stands in the container 12 and takes the shower 18 in a normal fashion, washing their body while shifting the position of each foot 24 slightly and also shifting their weight from foot 24 to foot 24 as they flex and move during the course of the shower 18, as is common.

The sand (as the abrasive material 26) works its way up between the toes of the foot 24, cleaning and finely abrading these oft neglected body parts. The foam 28 cooperates with the lining 32 during the shower 18. The foot 24 sinks into the foam 28 which stretches the lining 32 in various places.

The result is that the lining 32 forces some of the abrasive materials 26 into contact with a side 24*b* of the foot 24, thereby automatically cleaning both the underside 24*a* and the side 24*b* of the foot 24.

If the user desires, he or she may actually rub the underside 24*a* or the sides 24*b* or both of the foot 24 against the lining 32 on the sides of the container 12.

While other materials can be used for the lining 32, the artificial grass turf provides advantages in that it (along the sides of the container 12) also helps to cleanse and massage the foot 24 while retaining the bulk of the abrasive material 26 on top and in between the "blades" on top. This (the blades of artificial grass) prevent excessive shifting of the abrasive material 26 from occurring.

The lining 32 also permits the water from the shower 18 to pass through itself (the plane of the lining 32) and reach the lower level (bottom) of the container 12 where it drains out through the openings 20. In this manner, the lining 32 acts as an upper level screen that retains the overwhelming bulk of the abrasive materials 26 on top while allowing water to pass through. The soap 28 is similarly washed away during each shower 18 thereby leaving the foot cleansing device and method 10 clean and ready for the next usage.

The soap 38 can include bath oils or bath crystals, as desired. When the user is done with the shower 18, each foot 24 has been automatically cleaned without requiring any additional time. Also, there is no need for the user to raise one leg for cleaning of the foot 24 dangerously high while attempting to balance for a long period of time upon the other. Each foot 24 smells fresh, is clean, and has had some of the dead skin removed when the shower 18 is complete.

The process of taking the shower 18 while standing in the container 12 causes the lining 32 to stretch and relax as described hereinabove from normal weight shifting and normal slight movements of each foot 24 while the foam 28 compresses and expands periodically as well. During these changes, the abrasive materials 26 contact the foot 24 in different areas and at varying pressures.

The effect transcends that of a mere automatic washing of the foot 24 and provides an experience that includes a massaging of the foot 24. The essence of a foot massage is to provide varying pressures of contact to various areas of the foot 24, which the foot cleansing device and method 10 provides. Not only does the user benefit from a thorough cleansing of the foot 24, the user also receives a foot massage every time he or she takes the shower 18.

Removal of dead skin has also been accomplished which promotes healthy feet while possibly decreasing the chances of contracting an athlete's foot fungal infection. If such an infection already exists, the foot cleansing device and method 10 promotes healing and aids in the absorption and resultant efficacy of medications that can then be applied.

If desired, coarser or more abrasive substances can then be substituted for the abrasive materials 26 or they can be progressively added to the current abrasive materials 26, as desired. More abrasive substances are especially useful for use as the abrasive materials 26 in removing dead and scaling skin, such as occurs with psoriasis, eczema, and other similar disorders. There is virtually no limit to what can be used for the abrasive materials 26 as long as it is retained in the container 12.

Most materials selected as the abrasive materials 26 are given preference if they tend not to adhere to the skin of the foot 24. This ensures that the abrasive materials 26 remain in the container 12 and are not transported out when the person leaves the shower 18 area. The user may also elect to slightly raise the foot 24 for a short period of time and allow water coming from the shower 18 to rinse any remaining abrasive material 26 off of the foot 24 and back into the container 12 before exiting.

Water from the shower 18 flows through the lining 32, around and through the foam 28, and out through the openings 20 in the bottom of the container 12 while maintaining the abrasive materials 26 in the container 12 on top of the lining 32. If any of the abrasive materials 26 pass through the lining 32 they are prevented from embedding in the foam 28 by the second netting 30 and from passing out through the openings 20 by the first netting 22. It is not desirable to have the abrasive materials 26 clog a shower stall or bath tub drain.

Periodically, the cords 36 are loosened and the abrasive materials 26 and the lining 32 and the foam 28 are removed for rinsing and drying. They are either then reused or replaced, when required.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A foot cleansing device, comprising:

(a) a container;

(b) means for draining water from said container;

(c) abrasive means disposed in said container, said abrasive means for contacting a portion of a foot that is adapted to be placed in said container, and including a section of foam disposed in said container, and including a lining disposed over said foam, said lining adapted for retaining a portion of said abrasive means on said lining, and wherein said lining includes an artificial grass turf and wherein said turf extends from said foam in said container up and over any sides of said container.

2. The foot cleansing device of claim 1 wherein said means for draining water from said container includes a plurality of openings in a bottom of said container.

3. The foot cleansing device of claim 1 wherein said abrasive means includes a plurality of abrasive particulates disposed in said container.

4. The foot cleansing device of claim 3 wherein said abrasive particulates include sand.

5. The foot cleansing device of claim 3 wherein said abrasive particulates include gravel.

6. The foot cleansing device of claim 1 wherein said foam includes an egg crate type of a foam, the egg crate foam having a flat side and an opposite side including a plurality of pointed protrusions, and wherein said opposite side is facing upward.

7. The foot cleansing device of claim 1 including a screen disposed around said foam.

8. The foot cleansing device of claim 1 including means for detachably-attaching said lining to said container.

9. The foot cleansing device of claim 8 wherein said means for detachably-attaching includes at least one cord that is adapted to cooperate with said container sufficient to secure said lining thereto when said at least one cord is sufficiently tight.

10. The foot cleansing device of claim of claim 1 including a screen disposed over said means for draining water, said screen for preventing particulates that include a size greater than that of an opening through said screen from passing through said screen.

11. A foot cleansing device, comprising:

(a) a container;

(b) a plurality of openings in a bottom of said container for draining water from said container;

(c) a screen for preventing particulates that include a size greater than that of an opening through said screen from passing through said screen, said screen disposed over said plurality of openings;

(d) a section of foam disposed over said bottom of said container;

(e) a second screen disposed around said section of foam;

(f) a lining of artificial grass turf disposed over said foam and extending up of all of the sides of said container and attached thereto sufficient to retain said liner in position, and (g) a plurality of abrasive granules disposed on said lining in said container, said abrasive granules including an abrasive material for contacting a portion of a foot that is adapted to be placed in said container.

12. A foot cleansing device, comprising:

(a) a container;

(b) means for draining water from said container;

(c) abrasive means disposed in said container, said abrasive means for contacting a portion of a foot that is adapted to be placed in said container, and including a section of foam disposed in said container, and including a lining disposed over said foam, said lining adapted for retaining a portion of said abrasive means on said lining, and including means for detachably-attaching said lining to said container, and wherein said means for detachably-attaching includes at least one cord that is adapted to cooperate with said container sufficient to secure said lining thereto when said at least one cord is sufficiently tight.

* * * * *